United States Patent [19]

Pape et al.

[11] 4,125,143

[45] Nov. 14, 1978

[54] CURTAIN OR DRAPERY HANGING ARRANGEMENT

[75] Inventors: Hermann Pape, Thunacker, Germany; Peter Schroeder, Oberwil, Switzerland; Rudolf Schmitz, Kastanienbaum, Fed. Rep. of Germany

[73] Assignee: Gardisette Holding AG, Switzerland

[21] Appl. No.: 631,197

[22] Filed: Nov. 12, 1975

[30] Foreign Application Priority Data

Nov. 12, 1974 [DE] Fed. Rep. of Germany ..... 2453460
Aug. 2, 1975 [DE] Fed. Rep. of Germany ..... 2534573
Sep. 26, 1975 [DE] Fed. Rep. of Germany ..... 2542943

[51] Int. Cl.[2] ..... A47H 13/14
[52] U.S. Cl. ..... 160/348
[58] Field of Search ..... 160/123–126, 160/330, 345, 346, 347, 348; 16/87 R, 87 B, 87.2, 84.7 R, 87.4 W, 87.6 R, 87.6 W, 87.8

[56] References Cited

U.S. PATENT DOCUMENTS 3,626,429 12/1971 Toder ..... 16/87.2

*Primary Examiner*—Peter M. Caun
*Attorney, Agent, or Firm*—Craig & Antonelli

[57] ABSTRACT

A hanging arrangement for curtains and draperies which includes a holding member permanently attachable to an upper edge of the curtain or drapery which holding member serves for the fixing of pleats or the like. A roller hanger or sliding hanger is detachably connected to the holding member and is displaceably guided in or on a curtain or drapery rail. The holding member and the roller or sliding hanger are joined by way of at least one pin engaging in a recess extending in the drawing direction of the curtain or drapery. The recess is partially open at one side and is arranged at the lower end of the hanger and/or at the upper end of the holding means. The at least one pin is attached at the upper end of the holding member and/or at the lower end of the roller or sliding hanger with the holding member and the rolling or sliding hanger each being resistant to a bending in the hanging plane of the curtain or drapery.

44 Claims, 20 Drawing Figures

CURTAIN OR DRAPERY HANGING ARRANGEMENT

The present invention relates to a hanging arrangement and more particularly to a hanging arrangement for curtains or draperies which includes a holding member permanently attachable to the upper edge of a curtain or drapery which holding member serves for the fixation of pleats or the like with a roller hanger or slider hanger being detachably connected to the holding member and being displaceable in or on a curtain rail wherein the holding member and the hanger are joined by way of pins engaging in recesses which extend in the drawing direction of the curtain and/or drapery and are partially open on one side thereof.

A curtain or drapery hanging arrangement is disclosed for example, in German Utility Model No. 7,408,260 which includes a holding member having a rail formed as a U-shaped profile member with recesses fashioned as bores being provided in the legs of the profile member in alignment with each other. The recesses are open by way of lateral slots extending obliquely in a downward direction. A hanger fashioned in the shape of a safety pin is provided and includes four externally extending pins with two of these pins being in alignment with each other. The four pins may be inserted in four corresponding bores of the holding member and can be clampingly held therein so that the hanger is firmly, though detachably, joined to the holding member. The hanger itself can, in turn, be hung or mounted into a roller hanger or sliding hanger so that the holding member can be pivoted with respect to the roller or sliding hanger vertically with respect to the drawing direction and to the hanging direction of the curtain. A disengagement of the connection between the roller or sliding hanger, on the one hand, and the holding member, on the other hand, is possible only by opening the hanger located behind the curtain and unhooking the same from the roller or sliding hanger with the connection being re-established in a reverse sequence. Although these manipulations can be accomplished relatively easily in case of a curtain which is not yet hung or suspended from a curtain rod, these steps can only be carried out with considerable difficulties in situations wherein the roller or sliding hangers are disposed in the rod.

A further hanging arrangement for curtains or draperies is known from German Utility Model No. 1,973,065 which discloses a holding member permanently attached to an upper rim of the curtain or drapery which holding member serves for the fixing of pleats or the like with a roller or sliding hanger being movably mounted on a curtain rod and being detachably joined to the holding member whereby a gathering or pleating of the curtain is permanently fixed, for example, also during a laundering operation. A hook can be attached at various vertical positions and can be hung into an eye of a roller or sliding hanger. The purpose of mounting the hook at various levels at the holding member is to make it possible to attach the roller or sliding hanger in varying vertical positions relative to the holding member. To prevent the hook from disengaging from the eye during the normal use of the curtain or drapery in the hung condition, the free loop of the hook must be fashioned relatively long; however, this has the disadvantage that the detachment of the hook-eye connection with the roller or sliding hanger disposed in the rail requires a relatively long movement of the hook obliquely upwardly or in an approximately horizontal position in each instance while simultaneously lifting the curtain or drapery upwards. In particular, if, as is customary, there is no required space available toward the curtain rod, the hook must first be pivoted rearwardly and then be pushed toward the front or pivoted toward the front and then pushed rearwardly.

A further hanging arrangement has been proposed in Swiss Pat. No. 481,617 which discloses a hanging device including, on the one hand, a roller or sliding hanger and, on the other hand, a bifurcate or forked holding member. The loops of a supporting strip attached to the upper end of a curtain or drapery are placed with simultaneous pleat formation onto the tines of the forked holding member. The holding member is also provided with two suspension bars having at their ends slotted holes engageable by pins attached to the roller or sliding hanger whereby the holding member is enabled to execute a pendulating motion entraining the curtain or drapery at right angles to the vertical suspension direction and at right angles to the displacement direction. Loops are attached to the roller or sliding hanger which can be placed over the free ends of the forked tines of the holding member to prevent a detachment of the curtain therefrom. If the holding member is to be detached from the roller or sliding member, a force, though minor, must be exerted in the displacement direction of the roller or sliding hanger while the roller or sliding hanger is retained in position. An establishment or disengagement of the connection between the holding member and the roller or sliding hanger is possible only if the latter is outside of the rail since otherwise the holding member would fall out of the supporting strip since it is definitely necessary to release the loops from the fork tines, and since the gathering of the curtain or drapery would have to take place on the backside of the curtain or drapery, which would be extremely cumbersome when the curtain or drapery is in the suspended or hung condition.

Additionally, DOS No. 2,301,721 proposes attaching a curtain to a draw carriage which is displaceable in two guide rails with the attaching being effected by means of a perforated strip provided at an upper end of the curtain or drapery with the draw carriage remaining in the guide rails when the curtain or drapery is removed.

The present invention is concerned with the task to provide a structurally simple hanger arrangement for curtains or draperies which eliminates the aforementioned short comings.

The present invention is based on the general problem of facilitating the hanging and unhanging of curtains or draperies especially before or after laundering, namely, in view of the fact that the roller or sliding hangers normally can be introduced into and removed from a curtain or drapery rod only at one end of the rod. The ends of the mounted curtain or drapery rods usually are located in residences at places accessible only with great difficulties. Furthermore, one prerequisite is that a pleating or gathering fixed by the holding means is retained even during washing with such pleating or gathering not being required before the curtain or drapery is hung again after a laundering or cleaning.

The underlying problems are solved in accordance with the present invention by providing a hanger arrangement which is fashioned so that during a hanging and/or removal of a curtain or drapery the roller or sliding hangers remain in the rail and/or can be introduced beforehand with the connection and/or the disconnection between the roller or sliding hanger, on the one hand, and the holding device, on the other hand, being readily established with one hand while at the same time the connection is such that it is not inadverently disengaged during the handling of the suspended curtain or drapery without impairing swinging motions of the curtain or drapery about an axis disposed in the drawing direction of the curtain or drapery.

According to the present invention, a recess or bore is provided and located at the lower end of a roller or sliding hanger and/or at the upper end of a holding member with one or more mutually aligned pins being mounted at the upper end of the holding member and/or the lower end of the roller or sliding hanger with the pin being received in the recess or bore. The roller or sliding hanger and the holding member are each resistant to a bending in the hanging plane of the curtain or drapery which plane is the plane evolved from the drawing direction and the hanging direction of the curtain or drapery. The roller or sliding hanger, on the one hand, and the holding member, on the other hand, are resistant, in the suspended condition, to bending against forces oriented at right angles to the hanging plane. An elastic connection, for example a clamping connection, is provided between the pin and the recess with the pin and recess being dimensioned so that a tensile force component necessary for releasing the clamping connection is larger than the force components which normally occur during usage of the curtain or drapery.

According to the present invention, the establishment or disengagement of the clamping connection is basically possible with one hand so that the corresponding activity can be readily executed especially since no operations need be conducted behind the curtain or drape. Furthermore, the curtain or drapery can be pivoted in accordance with the present invention about the pin or pins and may readily be suspended or removed at or from a given location along the curtain or drapery rod where the rod is most readily accessible, based on room relationships.

It is especially advantageous in accordance with the present invention to establish or disengage the clamping connection exclusively from the face side of the curtain or drapery and for this purpose, it is advantageous if the recess is formed as a laterally slotted bore with the bore being provided at the roller or sliding hanger with the slot of the bore being arranged toward the face side of the curtain and drapery. When the bore is provided at the holding means, it is advantageous to locate the slot toward the backside of the curtain or drapery to facilitate the removal of the pin or pins from the slotted bore. In both cases, for releasing the clamping connection, the holding member must be pulled out of the roller or sliding hanger by a person standing in front of the curtain or drapery with the pulling direction being in the direction of the person. For establishing the clamping connection the holding member is pressed into the roller or sliding hanger by the person in a direction away from the person. These are relatively simple and strength-conserving manipulations and facilitate the hanging and removal of the draperies or curtains. Since the roller or sliding hanger and the holding means are each inherently resistant to bending, these individual components cannot escape from forces effective in the pivot axis formed by the pin and recess which considerably contributes towards the accomplishing of a one-hand operation for mounting and removing the curtains or drapes.

Preferably, in accordance with the present invention the pin or pins have a conventionally circular cross-section the diameter of which is larger than the slot width of the slotted bore at its narrowest point whereby an elastic clamping action is attained.

According to a further advantageous feature of the present invention, an unintended release of the clamping connection is prevented by providing that the adjacent surface, as seen in the hanging direction, which guides the pin or pins during the pulling out or impressing of the pin or pins out of or into the slotted bore is disposed above the bottom of the slotted bore since in such case, in order to disengage the clamping connection, the holding means must be lifted a slight distance which, preferably, need merely amount to at most 1 millimeter.

According to yet another feature of the present invention, to attain an elastically clamping mounting, at least the part of the hanger arrangement containing the recess is formed of a hard-elastic material for example, a thermal plastic synthetic resinous material.

According to a further feature of the present invention, if two pins are provided, such pins are formed by an upper crosspiece of a T-section attached or formed on the upper side of the holding means. Alternatively, if the two pins are each attached with their outer end faces to side walls or projections arranged on the top side of the holding means, the pin arrangement itself can be used as a provisional suspension device. By virtue of this construction a curtain or drapery provided with the holding means may be finished with respect to its decorative aspects and shipped and stored in a packaging unit provided with a rail adapted to receive the pins. A packaging unit of this type is disclosed, for example, in commonly assigned U.S. patent application Ser. No. 427,994, now U.S. Pat. No. 3,917,065, which is incorporated herein by reference to the extent necessary in understanding the present invention.

According to an advantageous further development of the present invention, it is possible to attach the holding means to loops of a supporting strip arranged at the upper edge of a curtain or drapery. By virtue of this construction it is possible to utilize all the advantages inherent in the present invention also in situations wherein the curtains have a supporting strip along the upper edge to which the holding means is, in turn, attached.

According to a further, particularly advantageous embodiment of the present invention, an unintended disengagement of the clamping connection between the hanging member and the sliding or roller hanger is securely prevented by providing abutment surfaces on the element carrying the recesses, on the one hand, and on the element carrying the pin or pins on the other hand. The abutment surfaces are associated with each other and have a predetermined spacing in the hanging condition in the hanging direction which spacing is smaller than the greatest distance projected on the hanging plane, of the zone of the recess closest to the other element from the surface guiding the pin or pins during the establishment or disengagement of the clamping connection. If in the normal hanging position the holding member and the roller or sliding hanger are shifted in a mutual relationship in opposition to the hanging direction, the clamping connection cannot be disengaged because the pin or pins cannot be removed from the recess. This embodiment can be further developed so that even a more versatile combination possibilities of the holding member, on the one hand, and the roller or sliding hanger, on the other hand, can be effected.

Such a further development can be realized, for example, by providing a surface zone on one of the two elements adjacent the abutment surface with the spacing of the surface zone from the recess being somewhat larger than the spacing of the surface region at the other element disposed in the pivoting path of this surface zone from the recess. Furthermore, the surface zone and surface region can be pivoted under at least a partial elastic deformation of at least one part past each other. A clamping mounting of the pins in the recesses is no longer provided and, consequently, there is extensive freedom with respect to the shaping of the recesses and with respect to their arrangement in an associated surface.

Thus, in accordance with the present invention, it is possible, for example, to provide several recesses into which the pins can be selectively hung. Therefore, a hanger can be fashioned, for example, so that it can be hung into a certain rail in one position and, after a rotation of 90° about its longitudinal axis it can be hung in a different rail. The holding means can be pivoted about the pins within a specific angular range with the pivoting motion, during normal use, being limited by the mutual abutment and/or clamping engagement of the surface zone on one element and the surface region on the other element. Only when a force is exerted which overcomes the resistance due to the abutment or clamping engagement can the holding means be pivoted to such an extent that both parts can be disengaged from each other. Suitably, the surface region with the smaller distance from the recess is formed by one of the abutment surfaces. Furthermore, it is advantageous to provide that the surface zone extends at least partially in parallel to the recess whereby the surface zone can have a certain longitudinal extension so that no point-like contact exists on the surface region.

Furthermore, it is especially advantageous in accordance with the present invention to form the surface zone by an edge between the associated abutment surface and an inclined surface. In this arrangement, the sliding or roller hanger and holding member are pivoted relative to one another to such an extent that the abutment surface is then disposed approximately in parallel to the inclined surface. Preferably an elastic pivotal resistance occurs in this arrangement in the area of the edge. In this particularly advantageous embodiment the element having the surface zone with the larger spacing from the recess has the cross sectional shape of a truncated pyramid with the at least one recess being arranged in the larger surface thereof and with the smaller surface of the truncated pyramid being disposed approximately parallel thereto and serving as the abutment surface with at least one lateral face of the pyramid forming the inclined surface. When two inwardly projecting mutually aligned pins are provided on one of the elements of the holding member or the sliding or roller hanger and associated recesses are arranged on the other element of the holding member or sliding or roller hanger than it is of special advantage to provide on the other element two pairs of recesses arranged vertically to each other which recesses are selectively engageable by the pins. This embodiment in particular makes it possible to fashion the hanger arrangement with great versatility as noted hereinabove. The sliding or roller hanger can be released from its connection with the holding member than rotated by 90° about its longitudinal axis and then reconnected to the holding means. Depending on the construction of the hanger this can provide adaptability to at least two different types of rails. For example, an oblong slide can be attached to the hanger. Suitably, the section having the shape of the truncated pyramid is mounted to the hanger.

According to a further advantageous feature of the present invention the hanger member is provided with at least one guide element arranged in proximity to the underside of the curtain or drapery rail which guide element extensively prevents a canting and insertion of the hanger in the rail.

Accordingly, it is an object of the present invention to provide a hanger arrangement for curtains or draperies which avoids by simple means the aforementioned shortcomings and drawbacks encountered in the prior art.

Another object of the present invention is to provide a hanger arrangement for curtains or drapes wherein a holding member to which the curtain or drapery is attached can be detached from or attached to a roller or sliding hanger with a simple motion, without motion reversal during the disengagement or establishment of the connection and without there being the danger that the connection is disengaged during the normal usage of the curtain or drapery.

A still further object of the present invention resides in providing a hanger arrangement for curtains or draperies which is relatively simple in construction and therefore also relatively inexpensive.

A still further object of the present invention resides in providing a hanger arrangement for curtains or drapes wherein a pleating or gathering fixed by the holding means is retained even during a washing or laundering operation without the need for reforming the pleating or gathering before the curtain or drapery is rehung.

These and further objects, features, and advantages of the present invention will become more apparent from the following description when in taken in connection with the accompanying drawing which shows, for the purposes of illustration only, several embodiments in accordance with the present invention, and wherein:

FIG. 2 is a lateral view of the hanger arrangement of FIG. 1 on the same scale;

Figure 1:
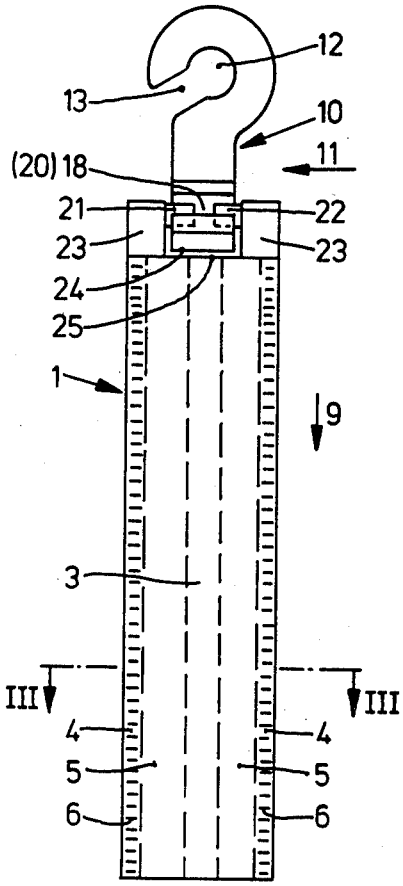
Figure 2:
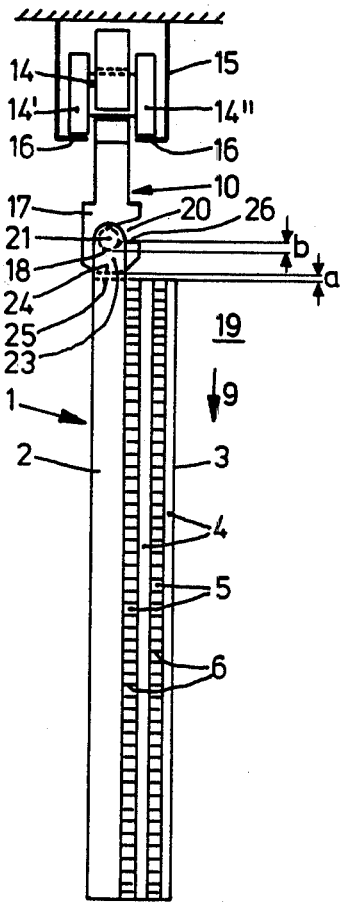
FIG. 2 is a frontal view, on an enlarged scale, of a hanger arrangement in accordance with the present invention.
Figure 3:
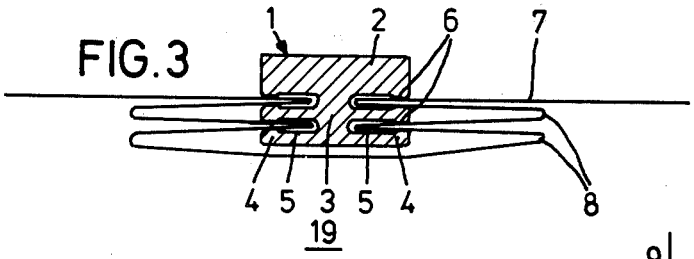
FIG. 3 is a horizontal cross-sectional view taken along line III—III of FIG. 1.
Figure 4:
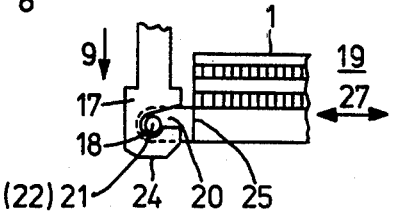
FIG. 4 is a partial cross-sectional view of FIG. 2 with the holding member in accordance with the present invention being pivoted upwardly.

Referring now to the drawings wherein like reference numerals are used throughout the various views to designate like parts, and more particularly to FIGS. 1–4, according to these figures, a one-piece elongated retaining body or holding member generally designated by the reference numeral 1 is provided having an approximately rectangular cross-sectional configuration (FIG. 3). A middle or center web 3 projects forwardly from a relatively flat back portion 2 of the holding member 1 with tongues or webs 4 projecting from the middle web 3 in spaced parallel relationship to the back portion 2. A slot 5 which is open toward the top and bottom and toward the outside over its entire length is provided between two webs each and between a respective web 4 and the back portion 2. In the embodiment of FIGS. 1–4, two slots 5, for example, a pair of slots are arranged in a respective plane with the longitudinal apertures being directed in opposite directions. Two slot pairs are arranged parallel to one another, however, it is also possible to provide three or more slot pairs or only a single pair of slots.

As can be seen particularly from FIG. 1, the slots 5 are relatively long in relation to their depth. Tooth-like extensions or projections 6 are provided at the outer edges or rims of the webs 4 and at the edges of the back portion 2 facing the associated slots whereby mutually opposite projections coordinated to a respective slot alternately overlap in a manner such as described in U.S. Pat. No. 3,861,001 the disclosure of which is incorporated herein by reference to the extent necessary in understanding the present invention.

As shown most clearly in FIG. 3, the curtain or drapery may be clampingly held in the slots 5 of the holding member 1 so that a dual T-shaped pleat 8 results.

A roller hanger 10 is detachably mounted on the top side of the holding member 1 with at least one bore or recess 12 being provided at the upper portion of the hanger 10. The bore 12 extends at right angles to both the curtain or drapery normal hanging direction indicated by the arrow 9 (FIGS. 1, 2) and the curtain or drapery displacement direction indicated by the arrow 11 (FIG. 1) which latter direction is arranged at a right angle to the normal hanging direction 9. The bore 12 is connected with an obliquely inclined outwardly and downwardly extending cutout or notch 13 the width of which is slightly less than the diameter of the bore 12. Since the entire roller hanger is molded in one piece of thermal plastic, hard elastic material, a conventional one piece slide roller 14 can be pressed into the bore 12 in a conventional manner by way of the notch 13 and be retained thereat elastically whereby the fastening of the curtain or drape at a curtain or drape rail 15 is made possible.

As shown most clearly in FIG. 2, the curtain or drapery rail 15 has a slotted box-shaped profile which opens in a downward direction whereby two rollers 14', 14'' of the sliding roller 14 roll along the respective lower legs 16 which project horizontally toward the inside of the rail 15.

The lower portion of the roller hanger 10 includes a thickened or widened section 17 in which is fashioned a recess or bore 18 the axis of which extends in the displacement direction 11. The recess or bore 18 is formed, in the direction toward the face side 19 of the curtain or drapery, with a slot 20 extending approximately horizontally or slightly upwardly and outwardly as can be seen most clearly in FIGS. 2 and 4. Two mutually aligned pins 21, 22 are arranged on the top side of the holding member 1 and engage or are received in the bore 18. The pins 21, 22 are supported against side walls or projections 23 arranged on the top side of the holding member 1. The pins 21, 22 may be fashioned so as to be molded as a single piece with the holding member 1. As with the hanger 10, the entire holding member 1 inclusive of the side walls or projections 23 and pins 21, 22 is molded in one piece of thermal-plastic hard elastic synthetic resinous material.

The pins 21, 22 have a circular cross section the diameter of which is somewhat larger than the width of the slot 20 at the transition into the bore 18 so that the pins 21, 22 can be introduced into the bore 18 or removed therefrom only from the side through the slot 20 under an elastic deformation of the thickened or widened section 17 and/or an elastic deformation of the pins 21, 22. In the normal hanging position of the holding member 1, as shown in FIGS. 1 and 2, the thickened or widened section 17 extends so that its lower edge surface 24 is disposed directly above the top side or upper edge surface 25 of the holding member 1 with the surfaces 24, 25 serving as abutment surfaces. A spacing *a* is provided between the two abutment surfaces 24, 25 which spacing is considerably less than a vertical distance *b* provided between the lower bottom of the bore 18 and a lower slot-defining surface 26. By virtue of this construction, a disengagement of the holding member 1 from the roller hanger 10 in the position shown in FIGS. 1 and 2 is impossible since, if the holding member 1 is lifted against the normal hanging direction 9, the two abutment surfaces 24, 25 would come into mutual abutment prior to the pins 21, 22 arriving in front of the slot 20. Therefore, the pins 21, 22 could not be pulled out past the lower slot-defining surface 26. Disengagement of the holding member 1 from the roller hanger 10 can only be effected if the holding member 1 is pivoted upwardly toward the face side 19 of the curtain or drape whereby the abutment surfaces 24, 25 are free of each other so that the pins 21, 22 may then be pulled out of the slot 20 and/or pressed into this slot 20 in the direction of arrow 27 as shown most clearly in FIG. 4.

Figure 5:
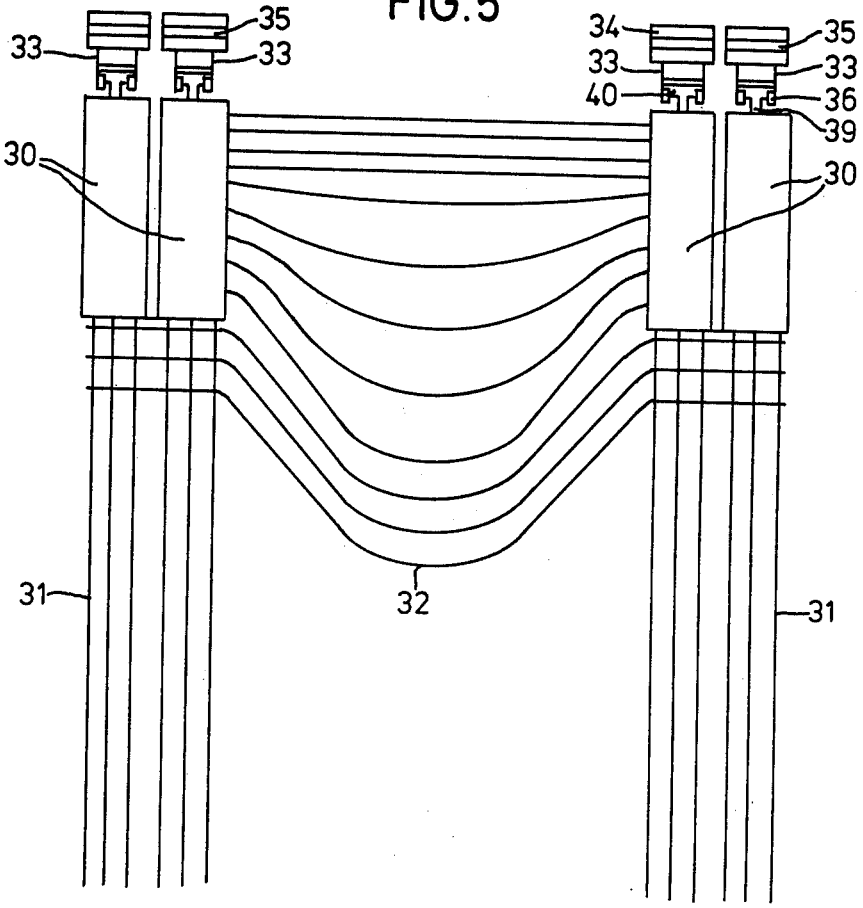
FIG. 5 is a frontal view of a further holding arrangement in accordance with the present invention having a suspended curtain or drape mounted thereby.

According to FIG. 5, a modified holding member 30 is provided for holding a curtain or drape fabric consisting of vertical bands 31 and bridging threads 32 which extend over two spaced-apart neighboring bands with the curtain being held and gathered in such a way that the impression of a swag-type drapery is obtained. A holding member 30 and curtain fabric 31, 32 are disclosed in the aforementioned commonly assigned U.S. patent application Ser. No. 466,548, now U.S. Pat. No. 3,921,696, which is incorporated herein by reference to the extent necessary in understanding the present invention.

As shown in FIG. 5, the holding member 30 is arranged in pairs with a sliding hanger generally designated by the reference numeral 33 being detachably mounted to the top side of the respective holding members 30. Each sliding hanger 33 is provided at the upper edge thereof with a sliding element 34 which has the form of a bulky or large double-T configuration which defines grooves 35 disposed in parallel to the displacement direction 11 of the curtain or drape. The curtain or drape rail 15 has a slotted box-shaped profile which opens in the downward direction with the lower legs 16 which project horizontally toward the inside of the rail 15 being disposed or extending into the grooves 35. As shown most clearly in FIG. 7, two spaced bow-like hooks 36 are arranged at the underside of the sliding element 34 with each of the hooks 35 having a bore 37 which is aligned with the corresponding bore 37 in the other hook 36. The bores 37 serve as recesses and are opened by way of slots 38 which likewise are aligned in the displacement direction 11 of the curtain or drape and are open toward the face side 19 of the curtain or drape.

Figure 6:
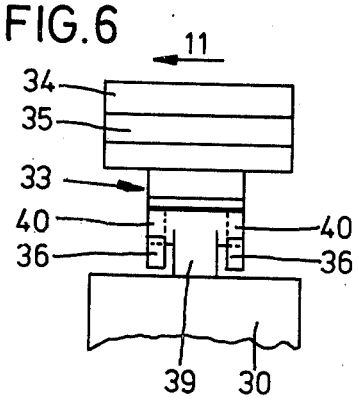
FIG. 6 is a partial frontal view, on an enlarged scale, of the hanger arrangement of FIG. 5.
Figure 7:
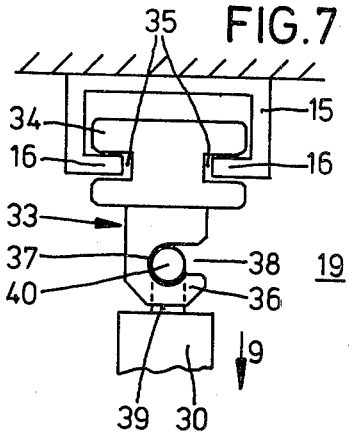
FIG. 7 is a lateral view of the hanger arrangement of FIG. 6.

As shown most clearly in FIGS. 6 and 7, a T-shaped section 39 is mounted on the top side or upper edge of the holding member 30 whereby the upper cross member of the T-shaped section forms two pins 40 which may be introduced or removed from the bores 37 through the slots 38. The pins 40 have a diameter which is somewhat larger than the slots 38 whereby the pins 40 are inserted into the associated hook portions 36 by the hook portions 36 being elastically widened. The dimensioning of pins 40, bores 37, and slots 38 are the same as in the embodiment described in connection with FIGS. 1–4 so that, since there are not abutment surfaces, a disengagement or connection of the holding member and the sliding hanger 33 is possible if the holding member is not pivoted upwardly toward the face side 19 of the curtain but merely lifted so that the pins 40 may be displaced outwardly through the slots 38 upon overcoming the elasticity maintaining the pins 40 in such slot.

Figure 8:
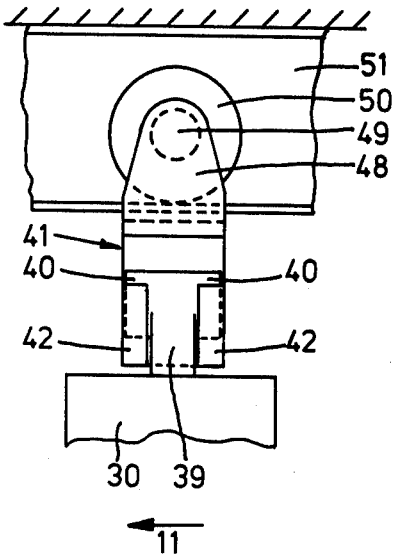
FIG. 8 is a partial frontal view of a further embodiment of a hanger arrangement in accordance with the present invention.
Figure 9:
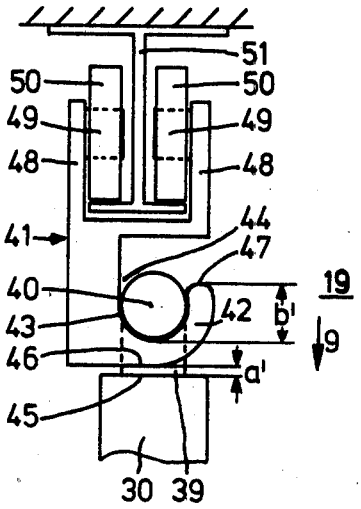
FIG. 9 is a lateral view of the hanger arrangement of FIG. 8.

According to FIGS. 8 and 9, the holding member 30 is provided at the top side thereof with a T-shaped member 39 with the cross member of the T-shaped section forming pins 40 which extend in the displacement direction 11 of the curtain or drape. The pins 40 are received in aligned recesses or bores 43 provided in spaced bow-shaped hooks 42 provided at the lower end of the roller hanger generally designated by the reference numeral 41. The bores 43 have upwardly open slots with the width of the slots 44 being less than the diameter of the pins 40. The top side or upper surface 45 of the holding member 30 and the bottom or lower surface 46 of the hooks 42 form abutment surfaces which, during normal suspension of the curtain or drapery in the hanging direction 9, have only a slight spacing *a'* from each other which spacing, in any event, is considerably less than the spacing *b'* provided between the bottom of the bore 43 and the top side or upper surface of the end 47 of the hooks 42. By virtue of this construction, a disengagement and connection of the roller hanger 41 and holding member 30 can be carried out only if the holding member 30 is pivoted upwardly approximately by at least 90° toward the face side 19 of the curtain or drape.

Two upwardly extending projections or side walls 48 are provided at the upper end of the roller hanger 41 with the side walls being disposed at right angles to the hanging direction 9 and the displacement direction 11 of the curtain or drapes. The side walls or projections 48 have mutually aligned inwardly extending axle stubs 49 on which sliding rollers 50 are rotatably mounted. The roller hanger 41 may be mounted on a curtain or drapery rail 51 which has a double T-shaped profile with the rollers 50 riding along the surfaces of the cross member of the T-shape as can be seen most clearly in FIG. 9.

Figure 10:
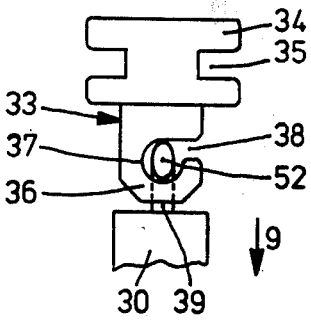
FIG. 10 is a partial lateral view of a further embodiment in accordance with the present invention.
Figure 11:
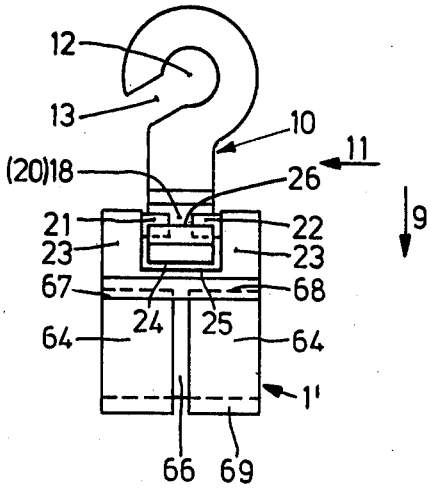
FIG. 11 is a frontal view on an enlarged scale, of an additional embodiment of the hanging arrangement in accordance with the present invention.

According to FIG. 10, a holding member 30 is provided at its upper end with a pin 52 of a non-circular cross-section which pin is received in aligned bores 37 provided in spaced hooks 36 on the sliding hangers 33. As shown in FIG. 10, the pins may have an eliptical configuration with the major axis being substantially equal to the diameter of the bore 37 and the minor axis being slightly larger than the width of the slots 38. By virtue of this construction, in the normal hanging direction 9 of the curtain or drape, the larger dimension or major axis of the pin 52 extends in the hanging direction 9 so that the pin 52 cannot be pulled toward the outside of the hooks 36 through the slot 38. Furthermore, the pin 52 cannot be inserted or removed from the hooks 36 without first pivoting the holding member by about 90° so that the smaller dimension or minor axis of the pin 52 is brought into alignment with the slot 38. Since the minor axis of the pin 52 is slightly larger than the slot 38, a slight elastic deformation of the hook and/or the pin 52 is required to remove and re-insert the pin 52.

It is also possible in accordance with the present invention to arrange to bores 18, 37 or 43 and the pins 21, 40 or 42 vertically so as to extend in the hanging direction 9 and at right angles to the displacement direction 11. This construction would function in principle as the above-described constructions; however, the roller or sliding hanger would have to be held with the users second hand for establishing and disengaging the connection since the force expended for disengagement and/or connection of the roller or sliding hanger and the holding member would be effective in the displacement direction 11 of the curtain or drapery.

According to FIGS. 11–15, a holding member 1' is provided which includes a rear plate 65 and two plate-shaped hooks 64 arranged at the lower longitudinal edge of the plate 65. The hooks 65 are spaced from each other to define a slot 66 therebetween. A continuous lug-like edge 67 is provided on the rear plate 65 on the same side as the plate-shaped hooks 64. The edge 67 projects toward the front and in the downward direction. The upper ends 68 of the plate-shaped hooks 64 are locked under the edge 67 due to the elastic deformation of such edge as shown most clearly in FIG. 14.

Figure 15:
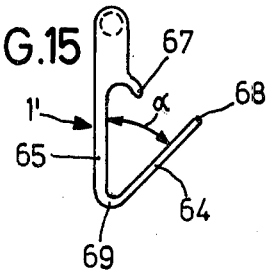
FIG. 15 is a side view of the holding member of FIGS. 11–14 in an opened condition.

The holding member 1' is injection molded in one piece of an elastic thermal plastic synthetic resinous material and, as shown most clearly in FIG. 15, during production, the plate-shaped hooks 64 are arranged so as to project from the rear plate 65 at an angle $\alpha$ which is equal to approximately 30°. The transition from the rear plate 65 to the plate-shaped hooks 64 is fashioned as a joint 69 which makes it possible for the hooks 64 to bend toward the rear plate 65 and effect a locking engagement behind the lug-like edge 67 of the holding member 1'.

Figure 12:
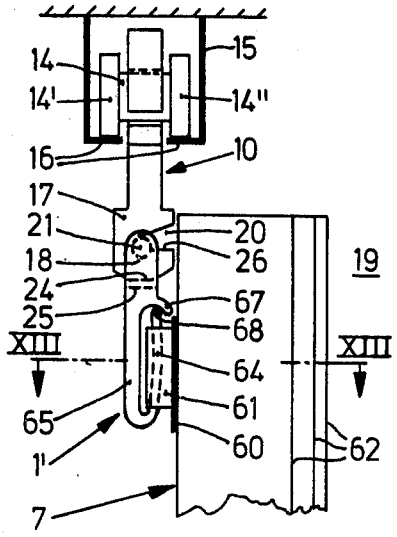
FIG. 12 is a lateral view of the hanging arrangement of FIG. 11 on the same scale with a curtain or drape being suspended thereby.
Figure 13:
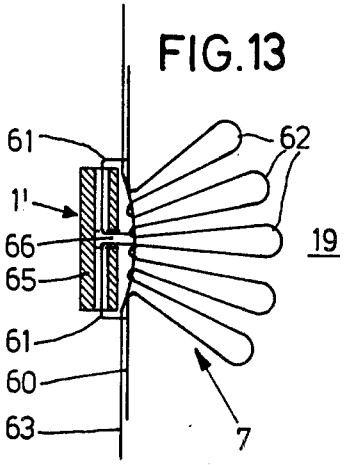
FIG. 13 is a horizontal cross-sectional view taken along line XIII—XIII of FIG. 12.

As shown in FIGS. 12 and 13, a supporting strip 60 is attached a short distance below the upper edge of the curtain 7 as is conventional by means of sewing or the like. The supporting strip 60 is provided with loops 61 on its side opposite the face side of the curtain 7. The curtain 7 is provided with one or more pleats 62 arranged at regular intervals which pleats may be produced for example by the strings 63 being guided in the supporting strip 60. One or more loops 61 are respectively placed on the plate-shaped hooks 64 of the holding member 1 and the hook 64 is then displaced or bent so that the edge 68 engages behind the lug-like edge 67. The loops 61 of the supporting strip 60 can be guided through the slot 66 as shown in FIG. 13.

Figure 14:
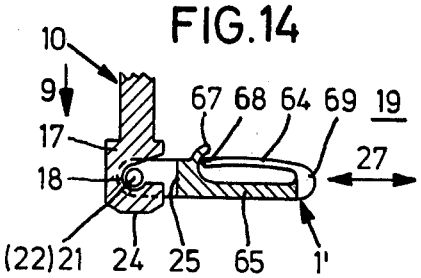
FIG. 14 is a partial cross-sectional view of the hanger arrangement of FIG. 12 with the holding member pivoted upwardly.

A roller hanger 10 is detachably mounted on the holding member 1' with a slide roller 14 being received in the bore 12 of the hanger 10. The constructional features of the roller hanger 10, slide roller 14, and mounting rail 15 are identical to the features described hereinabove in connection with FIGS. 1-4. Likewise the holding member 1' is provided with side walls or projections 23, pins 21, 22 and an abutment surface 25 which is adpated to be brought into abuting engagement with the abutment surface 24 of the hanger 10. As shown in FIG. 14, the holding member 1' may only be removed and inserted into the hanger 10 by displacing the holding member 1' about 90° from the hanging direction 9 and then pulling out or pressing in the pins 21, 22 into or out of the slots 20 in the direction of arrow 27.

Additionally, it is understood that the holding member 1' may be utilized with other rolling or sliding hangers such as, for example, the sliding hanger 33 of FIGS. 5-9. Likewise the holding member 1' may be provided with a pin having a non-circular cross section such as shown in FIG. 10.

According to FIGS. 16-20, a holding member generally designated by the reference numeral 1" is provided which holding member may be of the same construction as the holding member of FIGS. 1-4, FIGS. 5-10 or as FIGS. 11-15 fashioned as a clamp or bracket. Consequently, spaced side walls or projections 23 are arranged at the top side of the holding member 1" with aligned cylindrical pins 21, 22 respectively projecting from the side walls 23. The holding member 1" is molded in one piece of a hard elastic thermal plastic synthetic resinous material. A sliding hanger 10' is provided having at its lower end a section generally designated by the reference numeral 71 which section has the shape of an inverted truncated pyramid with the lower smaller edge surface 72 forming an abutment surface facing an abutment surface 25 of the holding member 1". The upper larger surface 73 forming a guide surface for the cylindrical pins 21, 22 of the section 71, disposed in an opposed relationship with the abutment face 72, is provided with four recesses 74, 75, 76, 77 which recesses are in the form of a cylindrical sector having an opening angle of at most 180°. The recesses 74-77 preferably have a semi-cylindrical shape. Two recesses 74, 75 and 76, 77 are disposed in respective alignment and arranged such that the respective pairs of recesses are arranged at right angles to each other, namely, each recess is disposed along a side bisector of the square guide surface 73. Preferably, the pyramidal shaped section 71 is a geometrical fragment of an equal angular pyramid having a square base.

Figure 16:
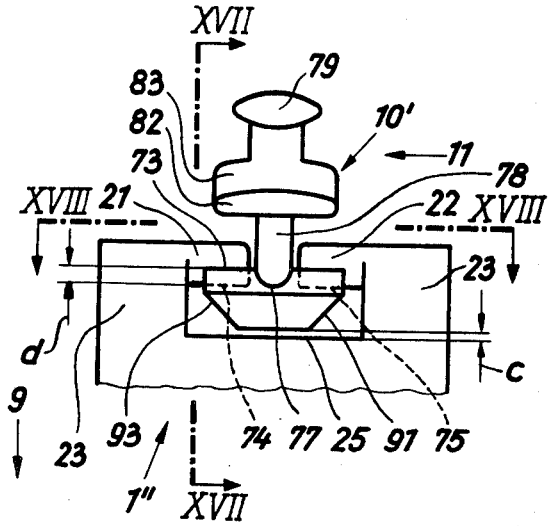
FIG. 16 is a frontal view, on an enlarged scale, of a further embodiment of a hanger arrangement in accordance with the present invention.
Figure 17:
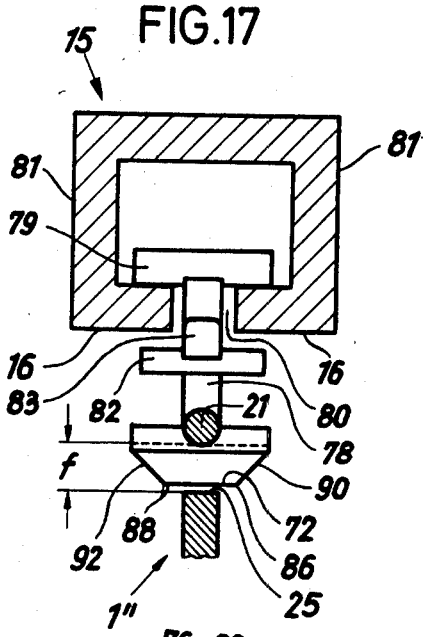
FIG. 17 is a partial cross-sectional view of the hanger arrangement of FIG. 16 taken along line XVII—XVII of FIG. 16 and arranged in a mounting rail.
Figure 18:
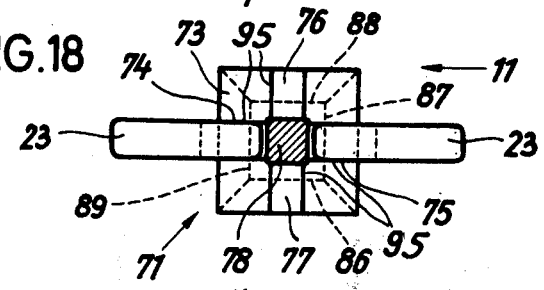
FIG. 18 is a partial cross-sectional view taken along line XVIII—XVIII of FIG. 16.

A rod-shaped web or tongue 78 is formed in the center of the guide surface 73 and extends at right angles thereto in the upward direction. An oblong slide 79 is attached to the upper end of the web 78 as can be seen most clearly in FIGS. 16 and 17 with FIG. 16 illustrating the narrow side of the slide 79 and FIG. 17 illustrating the long side of the slide 79. As shown in FIG. 17, the slide 79 is guided in a curtain or drapery rail 15 having a slotted box profile open at the bottom with the slide 79 sliding along the lower legs 16 of the curtain rail 15 which legs 16 project horizontally toward the inside of the rail 15.

If the spacing of the side walls 81 of the rail 15 is so small that the slide 79 cannot be introduced into the rail 15 with its long sides at right angles to the displacement direction 11 of the curtain or drape, then the sliding hanger 10' is rotated about its longitudinal axis by 90° and inserted so that the narrow sides of the slide 79, indicated in FIG. 16 are arranged vertically with respect to the displacement direction 11 of the curtain or drape. Guide elements 82, 83 are mounted at the web 78 and extend over the legs 16 of the rail 15 on the underside thereof so that the sliding hanger can be tilted in each case only to a minor extent at right angles to the displacement direction 11 and can thus be inserted into the rail 15.

Figure 20:
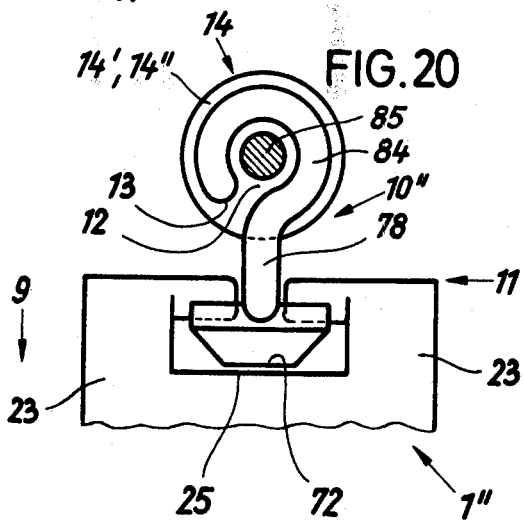
FIG. 20 is a frontal view, on an enlarged scale, of a further hanger arrangement in accordance with the present invention.

According to FIG. 20, a hanger generally designated by the reference numeral 11" is fashioned as a roller with a hook 84 being arranged at the upper end of the web 7 which hook has a bore 12 extending at right angles to the hanging direction 9 and the displacement direction 11 with the latter direction extending at right angles to the hanging direction 9. The bore 12 is provided with a cutout or notch 13 which extends obliquely toward the outside and in the downward direction with the width of this cutout 13 being somewhat less than the diameter of a pin or axle 85 on which two rollers 14', 14" are attached on respective sides of the hook 84. Consequently, the roller 14 can be introduced under elastic deformation through the cutout or notch 13 into the bore 12. In this construction, only two recesses 74, 75 need be provided in the surface 73 since a rotation of the roller hanger 10" by 90° about its longitudinal axis is unnecessary.

Figure 19:
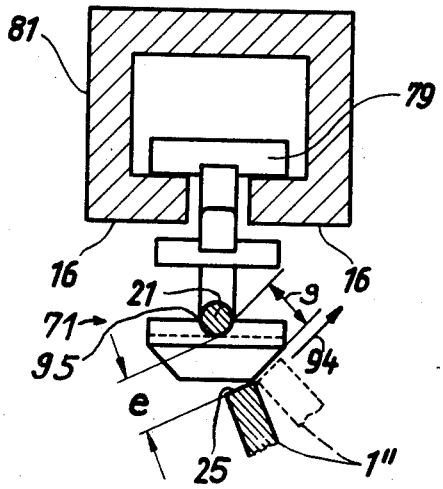
FIG. 19 is a partial cross-sectional view of the hanger arrangement of FIG. 16 arranged in a mounting rail with the holding member pivoted out of the hanging plane.

As shown in FIG. 16, the spacing $c$ between the abutment surfaces 25, 72 in the hanging condition of the curtain or drape is somewhat less than the depth $d$ of the recesses 74-77 so that in case of a compression of the sliding hanger 10' and or the roller hanger 10" and the holding means 1" the two abutment surfaces 25, 72 are in mutual contact without the pins 21, 22 being lifted out of the recesses 74, 75 and/or 76, 77, respectively. If, as shown in FIG. 19, the holding member 1" is pivoted about the pins 21, 22 disposed in the recesses 74, 75 and/or 76, 77, the abutment surface 25, forming one surface region, associated with the holding means 1" comes into contact with one of the edges 86, 87, 89, constituting one surface zone, between the abutment surface 72 and the inclined lateral surfaces 90, 91, 92, 93 of the section 71. The abutment surface 25 can be pushed over the edges 86–89 only under elastic deformation of the material in the zone of this edge and, optionally, under an elastic deformation of the pins 21, 22 and further regions of the holding means 1'' and/or of the hanger 10', and 10'' which is readily possible due to the fact that the holding means 41'' and the hanger 10' or 10'' are formed of a hard-elastic thermal plastic synthetic resinous material. Only after overcoming the elastic resistance offered by the edge 86 or 87 or 88 or 89, respectively, i.e. when the holding means 1'' is in the position shown in the dashed lines in FIG. 9, approximately at right angles to the inclined lateral surface 90 or 91 or 92 or 93, respectively, then the hanger 10' or 10'' can be lifted obliquely upwardly in the direction of arrow 94 off the hanger 10' or 10''. The spacing *e* between the recess and each edge 86–89 (FIG. 19) is somewhat larger than the spacing *f* between the recess and the abutment surface 25 (FIG. 17) and it is sufficient if the spacing *e* is larger by a few millimeters than the spacing *f*.

Additionally, an advantageous securing against an unintended disengagement of the hanger 10' and the holding member 1'' may be provided by making the distance *g* between the edge 95 of the recess 74, 75, 76, 77, over which the pins 21, 22, are pulled, and the associated oblique lateral surface 90, 91, 92, 93 larger by several tenths of a millimeter than the spacing *f*. The edge 95 between the recess 74, 75, 76, 77 and the upper larger guide surface 73 of the section 71 is the zone farthest removed from the oblique lateral surface 90, 91, 92, 93 which is to be overcome or traversed by the pins 21, 22 when the holding member 1'' is disengaged in the direction 94 from the hanger 10'.

In this latter type of construction, it is thus necessary first to overcome the resistance between the respective edges 86, 87, 88, 89 and the abutment surface 25 and then the resistance between the edge 95 and the pins 21, 22. These resistances, of course, must only be so large that they can be overcome by the user with one hand without any difficulties. In this connection, it is suitable to arrange the oblique lateral surfaces 90, 91, 92, 93 at an angle of 45° with respect to the upper larger surface 73 or the abutment surface 72 and to fashion the recesses 74, 75, 76, 77 in the form of a cylindrical sector with an opening angle of 180°.

By virtue of the above constructions in accordance with the present invention a hanger arrangement for curtains or draperies is realized wherein a roller or sliding hanger and a holding member are each resistant to bending in a hanging plane of the curtain and/or drapery which hanging plane is defined by the drawing direction of the curtain or drapery and the hanging direction thereof.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A hanging arrangement for curtains or drapes, the arrangement comprising: a holding means attachable to an upper edge of the curtain or drapes for holding and fixing pleats therein, a hanger means provided with at least one surface portion engaging a curtain or drape rail means for displaceably mounting said holding means at said rail means, means for detachably connecting said holding means to said hanger means including at least one connecting pin means provided at one of the two elements consisting of said hanger means and said holding means, and recess means provided in the other of said two elements for receiving said at least one pin means, said holding means and said hanger means each being resistant to a bending in a plane defined by a drawing direction and suspension direction of the curtains or drapes and including an upper and a lower end, said lower end of said hanger means defining a first abutment surface, said upper end of said holding means defining a second abutment surface, said first and second abutment surfaces being spaced from each other by a predetermined distance in a normal suspension of the curtain or drape, said recess means including a guiding surface means for guiding said at least one pin means into and out of said recess means, said guiding surface means being disposed at a predetermined distance above a bottom of said recess means, said predetermined distance between said abutment surfaces being less than the predetermined distance between said guiding surface means and the bottom of said recess means.

2. An arrangement according to claim 1, wherein a surface zone is provided on one of said holding means and said hanger means adjacent one of said abutment surfaces, said surface zone being spaced from said recess means by a predetermined distance, said holding means and said hanger means being pivotal with respect to each other about said pin means along a predetermined path with said surface zone being disposed along said predetermined path, a surface region provided on the other of said holding means and said hanger means spaced from said recess means in a normal suspension of the curtain or drape by a predetermined distance which is somewhat less than the predetermined distance between said surface zone and said recess means whereby said surface region may be pivoted past said surface zone under at least a partial elastic deformation of at least one of said holding means and said hanger means.

3. An arrangement according to claim 2, wherein said surface region is formed by a portion of one of said abutment surfaces.

4. An arrangement according to claim 1, wherein said surface zone extends in spaced parallel relationship with at least a portion of said recess means.

5. An arrangement according to claim 1, wherein said surface zone is formed by an edge disposed between one of said abutment surfaces and an inclined surface provided on one of said holding means and said hanger means.

6. An arrangement according to claim 5, wherein one of said holding means and said hanger means includes a portion having the shape of a truncated pyramid with a larger surface and a smaller surface disposed in spaced parallel relationship, said recess means being provided in said larger surface, said smaller surface defining one of said abutment surfaces, said inclined surface being formed by at least one lateral surface of the truncated pyramid portion.

7. An arrangement according to claim 6, wherein said truncated pyramid portion is provided on said hanger means.

8. An arrangement according to claim 7, wherein said hanger means includes an oblong slide having a lower surface portion engaging the rail means.

9. An arrangement according to claim 6, wherein said recess means on said larger surface are spaced from the inclined surface by a predetermined distance which is somewhat greater than the predetermined distance between said surface region and said recess means.

10. An arrangement according to claim 1, wherein at least two axially aligned pin means are provided on one of said holding means and said hanger means, said recess means includes two pair of recesses arranged on the other of said holding means and said hanger means, said two pair of recesses being disposed at right angles with respect to each other whereby said two pin means can be selectively brought into registry with the respective pairs of recesses.

11. An arrangement according to claim 1, wherein at least one guide means is provided at said hanger means, said guide means being arranged in proximity to an underside of the rail means and extending at least partially over the underside of the rail means.

12. An arrangement according to claim 1, wherein means for releasably securing an upper end of the curtain or drape are provided on said holding means at said lower end thereof.

13. An arrangement according to claim 12, wherein said at least one connecting pin means is provided at said upper end of said holding means, said connecting pin means being received in said recess means provided on said hanger means.

14. An arrangement according to claim 13, wherein said means for releasably securing an upper end of the curtain or drape includes at least one plate shaped hook provided on said holding means, said plate shaped hook terminating in a free end, an edge means provided on said holding means for selectively clampingly engaging said free end of said plate shaped hook to secure the curtain or drape to said holding means.

15. An arrangement according to claim 14, wherein at least two axially aligned connecting pin means are provided on said holding means, said two connecting pin means being received in said recess means provided in said hanger means.

16. An arrangement according to claim 15, wherein at least two spaced plate shaped hooks are provided on said holding means, each of said plate shaped hooks terminating in a free end, the respective free ends of said plate shaped hooks being clampingly engaged by said edge means.

17. An arrangement according to claim 16, wherein the curtain or drape includes at an upper edge thereof a supporting strip having a plurality of securing loops provided thereon, at least one of said securing loops being respectively disposed on said plate shaped hooks.

18. An arrangement according to claim 17, wherein said hanger means is a roller hanger including at least one rotatably mounted roller means displaceably mounted at the rail means.

19. An arrangement according to claim 1, wherein said recess means extends in the drawing direction of the curtain or drape.

20. An arrangement according to claim 1, wherein said hanger means is a roller hanger including at least one rotatably mounted roller means.

21. An arrangement according to claim 20, wherein said recess means is a bore, and wherein said guide means includes a laterally directed slot at said bore.

22. An arrangement according to claim 21, wherein said recess means is provided in said roller hanger at the lower end thereof, said at least one connecting pin means is provided on said holding means at the upper end thereof.

23. An arrangement according to claim 22, wherein said laterally directed slot is arranged toward the face side of the curtain or drapes.

24. An arrangement according to claim 21, wherein said at least one connecting pin means has a circular cross-section the diameter of which is larger than the width of said slot at a narrowest point thereof.

25. An arrangement according to claim 20, wherein at least two connecting pin means are provided, said two connecting pin means being formed by an upper cross piece of a substantially T-shaped member, said substantially T-shaped member being disposed on said upper end of said holding means.

26. An arrangement according to claim 20, wherein a pair of spaced upwardly extending projections are provided at the upper end of said holding means, at least one connecting pin means is disposed at the respective projections of said holding means in axial alignment.

27. An arrangement according to claim 20, wherein the curtain or drape includes at an upper edge thereof a supporting strip having a plurality of securing loops provided thereon, said holding means including means for releasably securing said plurality of securing loops.

28. An arrangement according to claim 1, wherein at least a portion of said recess means is made of an elastically yielding material.

29. An arrangement according to claim 1, wherein said hanger means is a sliding hanger provided with at least one surface portion which slidably engages the rail means.

30. An arrangement according to claim 29, wherein said recess means is a bore, and wherein said guide means includes a laterally directed slot at said bore means.

31. An arrangement according to claim 30, wherein said at least one connecting pin means is provided on said holding means at the upper end thereof.

32. An arrangement according to claim 31 wherein said laterally directed slot is arranged toward a face side of the curtain or drapes.

33. An arrangement according to claim 30, wherein said at least one connecting pin means has a circular cross-section the diameter of which is larger than the width of said laterally directed slot at a narrowest point thereof.

34. An arrangement according to claim 29, wherein at least two connecting pin means are provided, said two connecting pin means being formed by an upper cross piece of a substantially T-shaped member, said substantially T-shaped member being disposed on said upper end of said holding means.

35. An arrangement according to claim 29, wherein a pair of spaced upwardly extending projections are provided at the upper end of said holding means, and a connecting pin means is disposed at the respective projections of said holding means in axial alignment.

36. A hanging arrangement for curtains or drapes, the arrangement comprising:

a holding means attachable to an upper edge of the curtains or drapes for holding and fixing pleats therein, said holding means including upper and lower ends and a first abutment surface arranged at said upper end, a hanger means displaceably mounting said holding means at a curtain or drape rail means, said hanger means including upper and lower ends and a second abutment surface arranged at said lower end, said first and second abutment surfaces being spaced from each other by a predetermined distance in a normal suspension of the curtains or drapes, means for detachably connecting said holding means to said hanger means including at least one connecting pin means provided at one of the two elements consisting of said hanger means and said holding means, recess means provided in the other of said two elements for receiving said at least one pin means, said recess means including a guide means for guiding said at least one pin means arranged at a predetermined distance above a bottom of said recess means, said guide means includes a guide surface for guiding said at least one pin means into and out of said recess means, said guide surface being disposed at a predetermined distance above the bottom of said recess means, said predetermined distance between said first and second abutment surfaces being less than the predetermined distance between the guide surface and the bottom of said recess means, a surface zone provided on one of said holding means and said hanger means adjacent one of said abutment surfaces, said surface zone being spaced from said recess means by a predetermined distance, said holding means and said hanger means being pivotal with respect to each other about said pin means along a predetermined path with said surface region being disposed along the predetermined path, and a surface region provided on the other of said holding means and said hanger means spaced from said recess means in a normal suspension of the curtain or drape by a predetermined distance which is somewhat less than the predetermined distance between said surface region and said recess means whereby said surface region may be pivoted past said surface zone under at least a partial elastic deformation of at least one of said holding means and said hanger means.

37. An arrangement according to claim 36, wherein said surface region is formed by a portion of one of said abutment surfaces.

38. An arrangement according to claim 37, wherein said surface zone extends in spaced parallel relationship with at least a portion of said recess means.

39. An arrangement according to claim 37, wherein said surface zone is formed by an edge disposed between one of said abutment surfaces and an inclined surface provided on one of said holding means and said hanger means.

40. An arrangement according to claim 36, wherein one of said holding means and said hanger means includes a portion having the shape of a truncated pyramid with a larger surface and a smaller surface disposed in spaced parallel relationship, said recess means being provided in said larger surface, said smaller surface defining one of said abutment surfaces, said inclined surface being formed by at least one lateral surface of the truncated pyramid portion.

41. An arrangement according to claim 40, wherein said truncated pyramid portion is provided on said hanger means.

42. An arrangement according to claim 40, wherein said recess means on said larger surface is spaced from the inclined surface by a predetermined distance which is somewhat greater than the predetermined distance between said surface region and said recess means.

43. An arrangement according to claim 36, wherein at least two axially aligned pin means are provided on one of said holding means and said hanger means, said recess means includes two pairs of recesses arranged on the other of said holding means and said hanger means, said two pair of recesses being disposed at right angles with respect to each other whereby said two pins means can be selectively brought into registry with one of the respective pair of recesses.

44. An arrangement according to claim 36, wherein at least one guide means is provided at said hanger means, said guide means being arranged in proximity to an underside of the rail means and extending at least partially over an underside of the rail means.

* * * * *